US006234417B1

(12) United States Patent
Sauder et al.

(10) Patent No.: US 6,234,417 B1
(45) Date of Patent: May 22, 2001

(54) HOSE REEL RETRACTOR WITH UNI-DIRECTIONAL VISCOUS SPEED GOVERNOR

(75) Inventors: Gerald D. Sauder, Chandler; Andre J. Baca, Tempe, both of AZ (US)

(73) Assignee: Coxwells, Inc., Tempe, AZ (US)

( * ) Notice: Subject to any disclaimer, the term of this patent is extended or adjusted under 35 U.S.C. 154(b) by 0 days.

(21) Appl. No.: 09/323,300

(22) Filed: Jun. 1, 1999

(51) Int. Cl.[7] ..... B65H 5/365
(52) U.S. Cl. ..... 242/381; 254/377
(58) Field of Search ..... 242/379.1, 381, 242/286, 396, 396.5; 254/364, 377; 137/355.23

(56) References Cited

U.S. PATENT DOCUMENTS

| | | | | |
|---|---|---|---|---|
| 3,481,148 | * | 12/1969 | Muller et al. . | |
| 3,643,887 | * | 2/1972 | Kuhl | 242/381 |
| 4,067,545 | * | 1/1978 | Singer | 254/364 |
| 4,114,736 | * | 9/1978 | Scherenberg | 242/381 |
| 4,446,884 | | 5/1984 | Rader, Jr. | 137/355.23 |
| 4,523,664 | | 6/1985 | Soubry et al. | 182/233 |
| 4,681,279 | * | 7/1987 | Nakamura | 242/381 |
| 4,793,376 | | 12/1988 | Hare | 137/355.23 |
| 5,135,181 | | 8/1992 | Wesselink | 242/107.3 |
| 5,794,878 | | 8/1998 | Carpenter et al. | 242/381 |
| 6,080,007 | * | 7/2000 | Till | 242/396 |

* cited by examiner

*Primary Examiner*—Katherine A. Matecki
(74) *Attorney, Agent, or Firm*—John D. Titus

(57) ABSTRACT

A take-up reel for winding and storing an elongate hose or electrical cable comprises a reel supported by a stationary support shaft and urged in a first direction by a torsional spring. A viscous clutch assembly comprising multiple disks housed in a chamber filled with a viscous fluid is coupled to the reel to provide a retarding force that is proportional to velocity. The velocity proportional retarding force causes the rewind velocity of the reel to stabilize at a constant velocity. A one-way clutch is provided to decouple the viscous clutch from the reel when the hose or cable is being payed-out thereby permitting the hose or cable to be payed-out without resistance from the viscous clutch. By providing a unidirectional viscous clutch that acts to retard only the take-up velocity of the hose reel, it is possible to provide an apparatus that permits the hose to be payed-out at any speed while providing the substantial safety benefits of a viscous speed governor during take-up.

7 Claims, 3 Drawing Sheets

A
68
110
106
112
104
116
32
114
108
66
32
34
52
50
22
48
12
24B
26
30
58
26
58
24A
42
42
40
24
28
36
38
40
44
46
18

HOSE REEL RETRACTOR WITH UNI-DIRECTIONAL VISCOUS SPEED GOVERNOR

BACKGROUND

The present invention relates to take-up reels of the type for winding and paying out an elongated flexible member such as a cable, rope, hose or the like, and which automatically rewind the flexible member when it is released.

The art is replete with applications in which a flexible member such as a cable, rope, hose, electrical cord or the like is wound about a take-up reel for storage when not in use, and which is paid out by unwinding from the take-up reel to the appropriate length as required. A popular application for this arrangement is use of a flexible hose for carrying air, water, oil, grease, and the like from a reservoir to a dispensing nozzle at an automobile service station. For example, in the typical automobile service station, air is delivered from a compressor tank through a long pipe to a spring-loaded take-up reel about which is stored a length of tubular air hose. When air is needed, the air hose is pulled from the reel until the desired length is paid out. When the air hose is no longer in use, the end is released and a torsional spring acting on the hose reel rewinds the hose onto the reel.

The torque exerted by the torsional spring on the take-up reel causes the take-up reel, and with it the payed-out hose, to accelerate as the hose is taken up, with result that the terminal velocity of the hose may be quite high as the last bit of hose is retracted. The sudden stop of the mechanism when the end of the hose is reached can cause damage to the rewind mechanism and/or the hose. Moreover, the whipping action that occurs as a result of the uncontrolled rewinding speed can cause personal injury. Various breaking mechanisms have been proposed for automatically limiting the rewind rate of the take-up reel. For example, U.S. Pat. No. 4,446,884 to *Rader, Jr.* proposes use of a viscous dampening mechanism coupled between the spool and its support shaft. Being a viscous dampener, the retarding force exerted by the viscous dampener is directly proportional to the rotational speed of the reel. Accordingly, the reel will tend to seek a velocity at which the retarding force is equal to the force exerted on the reel by the torsional spring, such that the spool will attain a constant velocity. The viscous dampener disclosed in *Rader,* however, is rigidly attached to the support shaft and therefore exerts a retarding force on the hose reel irrespective of whether the hose is being payed-out or being retracted. In most applications, it is not necessary to regulate the speed at which the hose is payed-out. Accordingly, a viscous dampener that operates in both directions such as disclosed by *Rader* unnecessarily loads the hose as it is being payed-out, potentially leading to premature failure of the hose and/or the rewind mechanism. Accordingly, what is needed is a take-up reel with a viscous clutch that operates only when the hose is being retracted and therefore allows the hose reel to be decoupled from the viscous dampener when the hose is being payed-out.

SUMMARY OF THE INVENTION

The present invention satisfies the foregoing need by providing a hose reel assembly having a viscous clutch that is coupled between the hose reel and the stationary support shaft by means of a one-way clutch that engages the viscous clutch only when the hose reel is rewinding, not when the hose reel is paying-out the hose. In a preferred embodiment, the take-up reel comprises a stationary support shaft attached to a frame and a one-way clutch assembly supported for rotation by the stationary support shaft. The one-way clutch assembly is capable of rotating freely in one direction about the stationary support shaft but engages the stationary support shaft to prevent rotation in the opposite direction. The one-way clutch, in turn, is secured to a plurality of stator disks of a multi-disk viscous clutch. The rotor disks of the viscous clutch, in turn, are coupled to the hose reel. A chamber filled with a viscous fluid encloses the stator and rotor disks. The viscous fluid provides a sheering action to retard the relative motion between the stator disks attached to the one-way clutch assembly and the rotor disks attached to the hose reel. The multi-plate construction of the viscous clutch provides a highly efficient and compact retarding mechanism. A conventional torsional spring provides a biased urging the reel to fully rewind the hose wound thereon.

In operation, as the hose is payed out, a sheering force develops between the rotor disks coupled to the hose reel and the stator disks coupled to the one-way clutch. The sheering force exerts a slight torque on the one-way clutch causing the one-way clutch to disengage and freewheel about the stationary support shaft. Thus, the only resistance force exerted by the viscous clutch opposing this direction of motion is the torque necessary to overcome the friction inherent in the one-way clutch. Conversely, when the reel is being retracted under the urging of the torsional spring, a sheering force is developed between the rotor disks attached to the hose reel and the stator disks attached to the one-way clutch. In this direction, however, the one-way clutch engages the stationary support shaft thereby preventing rotation of the stator disks. The sheering force developed between the now static stator disks and rotor disks is proportional to the relative velocity between the stator disks and the rotor disks. Accordingly, as the rewind velocity of the hose reel builds, a counteracting torque is developed by the sheering of the viscous fluid between the stator and rotor disks until at a certain velocity, the forces balance and the hose reel attains a steady state velocity. The steady state velocity may be adjusted by, among other things, adjusting the viscosity of the fluid in the viscous clutch and/or varying the number of stators and rotors and their relative spacing.

By providing a uni-directional viscous clutch that acts to retard only the take-up velocity of the hose reel, it is possible to provide an apparatus that permits the hose to be payed-out at any speed without resistance from the viscous clutch while providing the substantial benefits of a viscous speed governor during take-up. The invention thus provides all of the safety benefits of a viscous speed governor without the unnecessary wear and tear inherent in a conventional bi-directional viscous clutch.

BRIEF DESCRIPTION OF THE DRAWING

The present invention will be better understood from reading of the following detailed description, taken in conjunction with the accompanying drawing figures in which like references designate like elements, and in which.

DETAILED DESCRIPTION

Figures 1, 3:
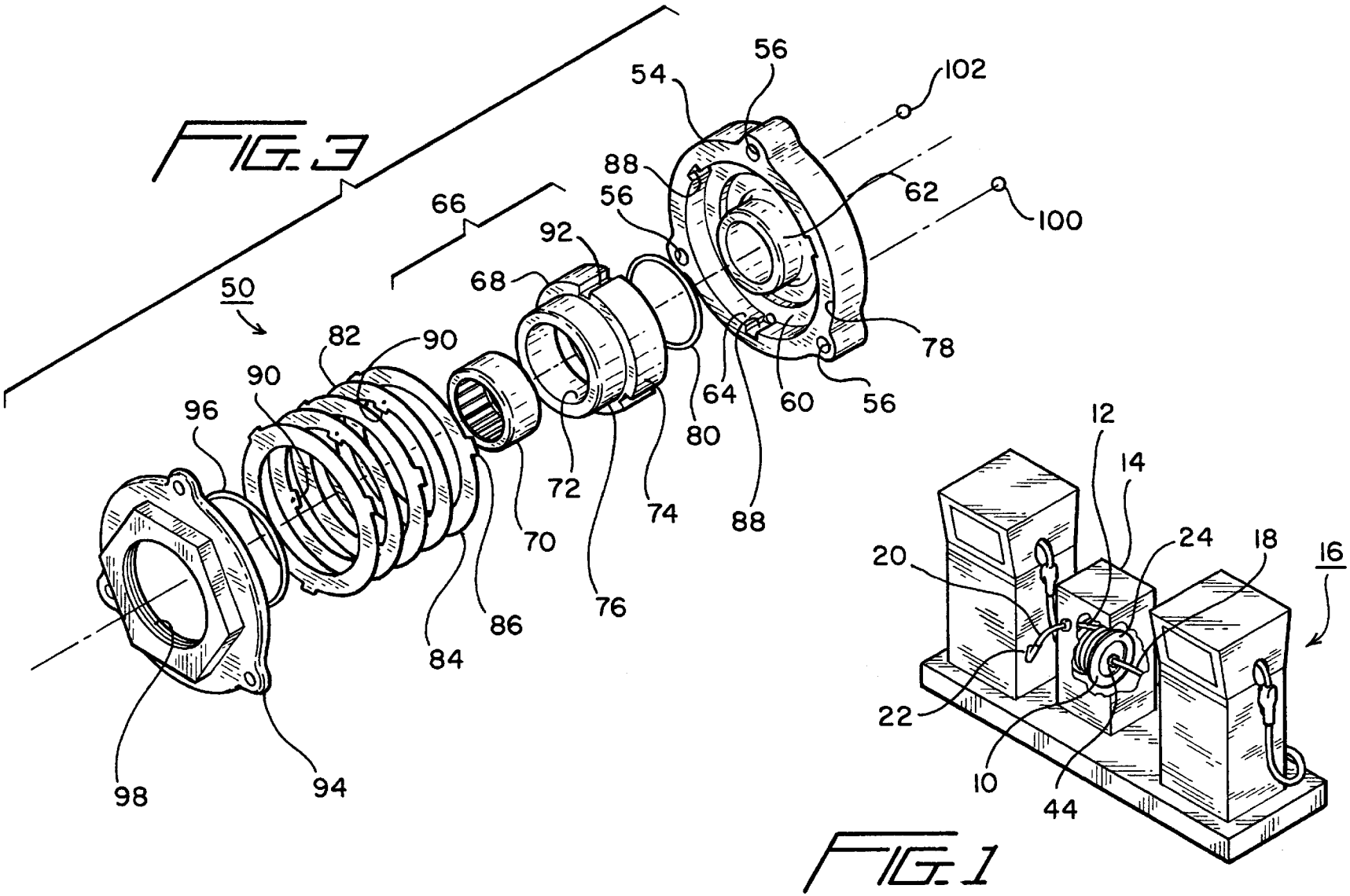
FIG. 1 is a perspective view of typical application of a hose reel retractor incorporating features of the present invention.
FIG. 3 is an exploded perspective view of the viscous clutch and one-way clutch assemblies of the hose reel of FIG. 2.

The drawing figures are intended to illustrate the general manner of construction and are not necessarily to scale. In the description and in the claims, the terms left, right, front and back and the like are used for descriptive purposes. However, it is understood that the embodiment of the invention described herein is capable of operation in other orientations that is shown and the terms so used are only for the purpose of describing relative positions and are interchangeable under appropriate circumstances.

With reference to FIG. 1, a reel assembly 10 having a uni-directional viscous clutch incorporating features of the present invention is illustrated, by way of example, as use for paying out and taking up a length of an elongate member such as high-pressure air hose 12 from a cabinet 14 mounted to a service station island 16. In this application, high-pressure air is delivered from an air compressor (not shown) to a conventional swivel joint 44 which delivers it to the inlet of air hose 12. The terminal end 20 of air hose 12 is fitted with a conventional air chuck or other terminal apparatus 22. When it is desired to provide high-pressure air service, the terminal end 20 of air hose 12 is pulled from the reel assembly 10 to the desired length. When the length of air hose 12 is no longer needed, terminal end 20 is released by the user to allow reel assembly 10 to rewind the hose under the urging of a torsional spring acting on the reel 24 of reel assembly 10.

Figures 2, 4:
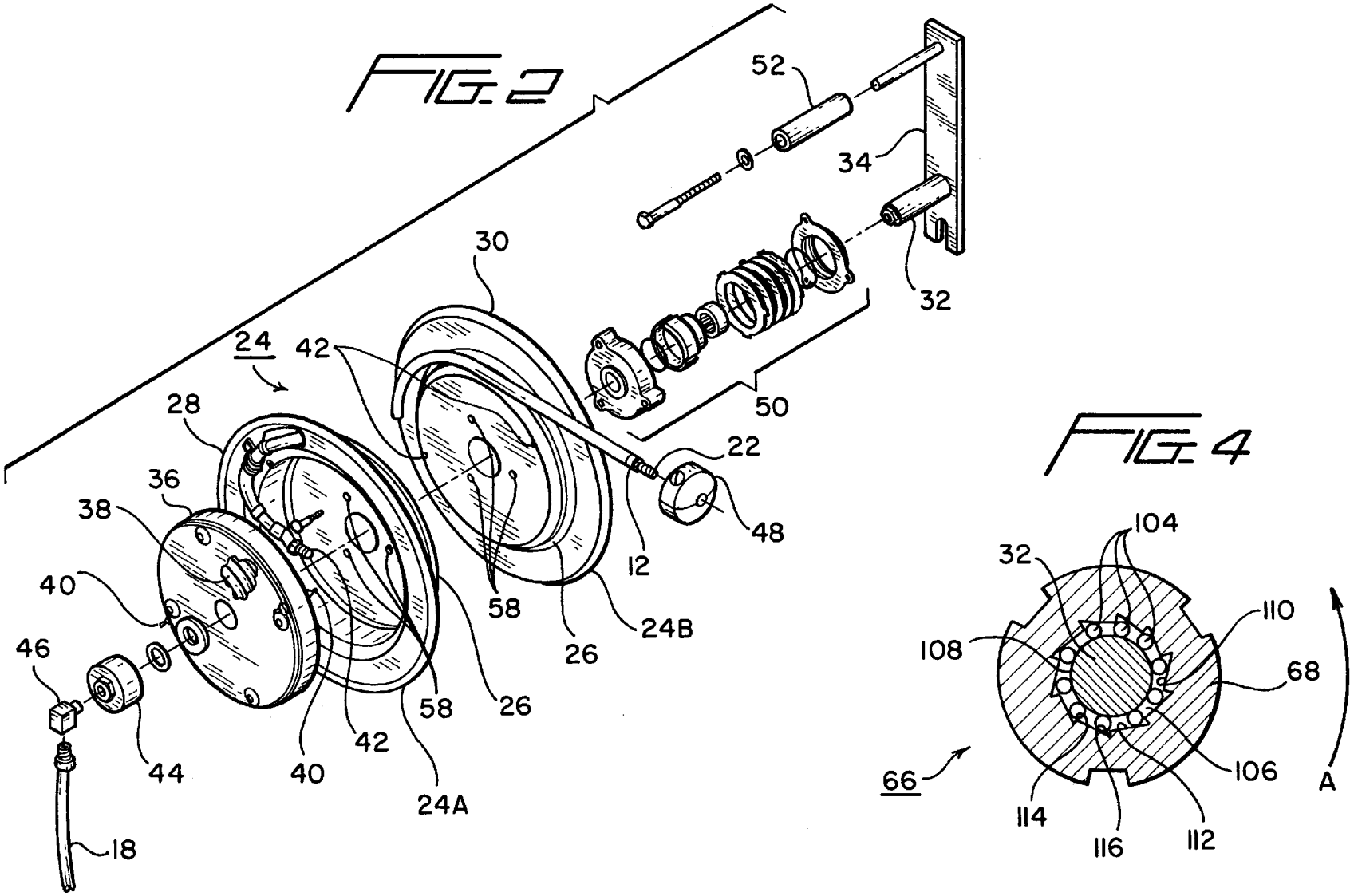
FIG. 2 is an exploded perspective view of a hose reel incorporating features of the present invention.
FIG. 4 is an end view of a one-way clutch assembly incorporating features of the present invention.
Figure 2A:
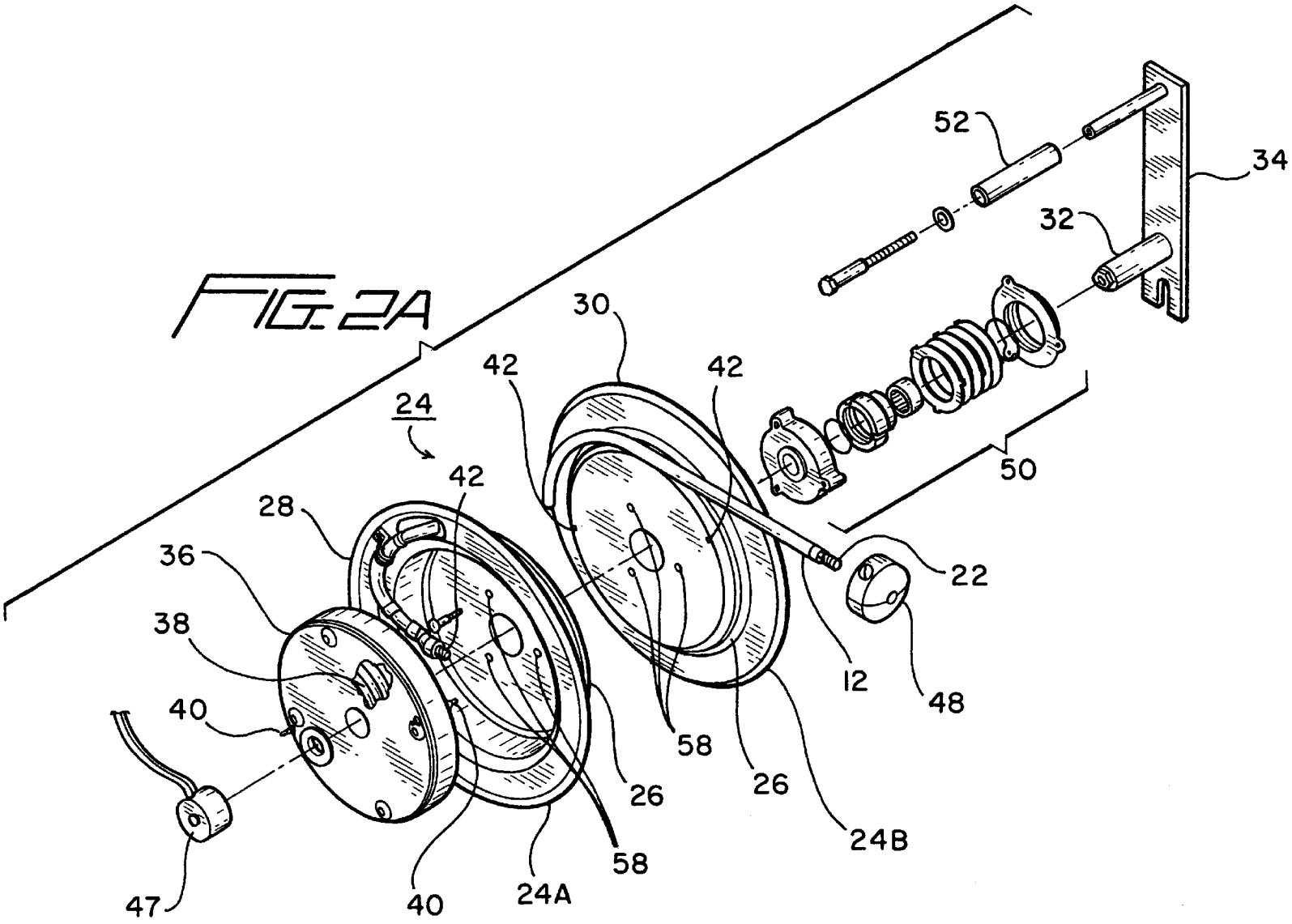
FIG. 2A is an exploded perspective view of a hose reel incorporating features of a second embodiment of the present invention.

With reference to FIG. 2, reel 24 of reel assembly 10 comprises outer-reel half 24A and inner-reel half 24B which are secured together to form a reel 24 having a substantially cylindrical body portion 26 with radially extending flange portions 28 and 30 at the respective inner and outer ends thereof. Reel 24 is supported for rotation by a stationary support shaft 32 attached to subframe 34. Subframe 34 in turn may be mounted to a wall, frame, or to the interior surface of an enclosure such as enclosure 14 shown in FIG. 1. Disposed within cylindrical body portion 26 is a spring can 36 in which is housed a conventional multiple turn torsional spring 38. Spring 38 may be a spiral wound spring similar to a watch spring, or may be a conventional negator spring. The outer end of torsional spring 38 is secured to spring can 36. The inner end of torsional spring 38 is secured to stationary shaft 32 by means of a slot and setscrew, keyed hub, or other conventional means. Spring can 36 is secured within body portion 26 by a plurality of studs 40 passing through corresponding apertures 42 in inner and outer reel halves 24A and 24B. Inner-end 42 of air hose 12 is coupled to inlet line 18 by means of a conventional swivel joint 44 via elbow fitting 46. (As shown in FIG. 2*a,* in an alternative embodiment of reel assembly 10 in which an electrical cord is wound about reel 24, a conventional slip-ring connector 47 is substituted for swivel joint 44). With reference again to FIG. 2, terminal end 22 of air hose 12 may be equipped with a conventional hose stop 48 to prevent air hose 12 from being withdrawn completely into cabinet 14. A snubbing roller 52 is attached to subframe 34 to act as a guide to constrain air hose 12 to wind onto reel 24. A uni-directional viscous clutch assembly 50 discussed more fully hereinafter, is disposed between reel 24 and support shaft 32 to provide a viscous retarding force that governs the retraction speed of reel 24 but does not inhibit the free paying-out of hose 12 from reel 24.

FIG. 3 is an exploded perspective view of the unidirectional viscous clutch assembly 50 incorporating principles of the present invention. Uni-directional viscous clutch assembly 50 comprises a housing 54 having apertures 56 adapted to be bolted to corresponding apertures 58 passing through outer and inner reel halves 24A and 24B (FIG. 2). Housing 54 includes an annular chamber 60 having a radially inward wall 62 and a radially outward wall 64. A one-way clutch assembly 66 includes a collar member 68 and a one-way clutch 70. One-way clutch 70 is a press-fit in bore 72 of collar member 68 and/or may be retained by conventional anaerobic thread locking adhesives such as LOCTITE, such that one-way clutch 70 is rigidly attached to collar member 68 without the possibility of rotation therebetween. One-way clutch assembly is disposed in chamber 60 such that keyed surface 74 is completely within chamber 60 while sealing surface 76 protrudes beyond flush with surface 78 of housing 54. A radial seal such as a conventional O-ring 80 seals inner-bore 72 of collar member 68 to radially inward wall 62 of chamber 60 thereby providing a fluid tight seal therebetween.

A plurality of stator disks 82 and rotor disks 84 each comprising disks of a hollow substantially circular cross-section are disposed in chamber 60 in an alternating fashion with the rotor disks attached to the housing 54 and the stator disks 82 interleaved therebetween and attached to the collar member 68 to form a plurality of annular gaps between stator disks 82 and rotor disks 84. In the embodiment of FIG. 3, the rotor disks are attached to housing 54 by means of a plurality of tabs 86 extending radially outward from rotor disks 84 engaging a plurality of corresponding slots 88 formed in radially outward wall 64 of chamber 60, however, other means of attaching the rotor disks 84 to housing 54 such as splines, clips, adhesives, or other conventional methods are within the scope of the invention. Accordingly, as used herein, the term "attached" when used with reference to the interaction between the housing 54 and the rotor disks 84 means rigidly attached or attached in such a way so as to preclude substantial rotation therebetween. As used herein with reference to stator disks 82 and rotor disks 84, a hollow "substantially circular" cross-section means that the majority of the surface area of the disks lie within a hollow circular region defined by an inner radius and an outer radius, but does not preclude the presence of splines, tabs or other irregularities along the inner and outer radii.

The stator disks 82 are attached to collar member 68 by means of a plurality of tabs 90 that engage a plurality of corresponding slots 92 formed in keyed surface 74 of collar member 68. As with the attachment of the rotor disks 82 to housing 54, the attachment of stator disks 84 to collar member 68 may be accomplished with splines, clips, adhesives, or other conventional methods that preclude substantial rotational motion between the stator disks 82 and the collar member 68. Accordingly, as used herein with respect to the attachment of the stator disks 82 to the collar member 68, the word "attachment" means, when used with reference to the interaction between the collar member 68 and the rotor disks 84, rigidly attached or attached in such a way so as to preclude substantial rotation therebetween such as with splines or the tabs 86 and slots 88 of the embodiment of FIG. 3 by "substantially" precluding relative motion between the stator and rotor disks and the housing and collar member, respectively, what is meant is that the relative motion is not so great as to prevent the viscous dampener from acting to retard the velocity of the reel in a multiple revolution application. Accordingly, a quarter-turn, a half-turn or even more of tolerance between the disks and their respective housing 54 and collar member 68 is tolerable so long as the disks would be precluded from making more than one revolution relative to their respective housing 54 and collar member 68.

A cover 94 seals against surface 78 of housing 54. A conventional radial seal such as O-ring 96 is disposed in an O-ring groove 98. O-ring 96 seals cover 94 against sealing surface 76 of collar member 68 thereby providing a completely sealed chamber 60. Chamber 60 is then filled with a viscous fluid such as 30,000 CS silicone fluid through fill plugs 100 and 102. It should be noted that use of a plurality of stator and rotor disks in a single chamber enables viscous clutch assembly 50 to be of substantially more compact construction than the single plate viscous dampener of the prior art.

FIG. 4 is an end view of a preferred one-way clutch assembly 66 comprising collar member 68 and one-way clutch 70 disposed about support shaft 32. One-way clutch 70 comprises a plurality of rollers 104 disposed within a cavity 106 defined by outer surface 108 of support shaft 32 and inner cylindrical surface 110 of one-way clutch 70. Outer surface 108 comprises a series of ramps 112 arranged in a saw tooth pattern around the perimeter of surface 110. The ramps are arranged such that the radial clearance between outer surface 108 of support shaft 32 at each of the tips 114 of ramps 112 is less than the diameter of rollers 104 and the radial clearance between surface 108 of shaft 32 and the root 116 of ramps 112 are greater than the diameter of rollers 114. Accordingly, as collar member 68 is rotated in the direction indicated by arrow A in FIG. 4, rollers 104 are jammed between outer-surface 108 of shaft 32 and inner-surface 110 of collar member 68 thus preventing substantial rotational motion between collar member 68 and shaft 32 (i.e. no more rotation than is necessary to effect the initial lock-up). Conversely as collar member 68 is rotated opposite the direction indicated by arrow A, roller members are freed to assume the orientation shown in FIG. 4 which permits them to slide easily over shaft 32 thereby providing substantially no resistance (i.e. other than ordinary friction) between collar member 68 and shaft 32 thereby permitting collar member 68 to freewheel about shaft 32.

As is evident from the foregoing, with the one-way clutch 70 oriented such that the direction indicated by arrow A in FIG. 4 corresponds to the take-up direction, as hose 12 is unwound from the reel 24, roller member 104 of one-way clutch 70 disengage from shaft 32 thereby permitting collar member 68 (and with it the rest of reel assembly 10) to freewheel about support shaft 32 resisted only by the torque exerted by torsional spring 38. When hose 12 is released, the rewind force developed by torsional spring 38 causes rotation of reel 24 in the take-up direction indicated by arrow A of FIG. 4. As this occurs, roller members 104 of one-way clutch 70 assume the engaged position against shaft 32 thereby preventing relative motion between collar member 68 and shaft 32. Stator disks 82, which are attached to collar member 68 therefore are held stationary within chamber 60 of housing 54, while rotor disks 84 rotate with housing 54 and reel 24 under the urging of torsional spring 38. As this occurs, the silicone fluid filling the gaps between rotors 84 and stators 82 is sheared, thereby giving rise to a viscous retarding force that is proportional to the relative velocity between rotor disks 84 and stator disks 82. Since this viscous retarding force is proportional to velocity, the retarding force will be small as the hose reel begins to move and will build as the velocity of the hose reel increases, until the retarding force balances the torque exerted by the torsion spring 38. Once the torques are equal, the hose reel will assume a constant rotational velocity thereby smoothly retracting the hose 12 onto reel 24 at a controlled retraction rate. As is evident from the foregoing, use of a uni-directional viscous clutch assembly 50 enables a controlled retraction rate to be effected without limiting the rate at which the hose may be payed-out, thus achieving the safety advantages of a viscous retarding mechanism without the deleterious effects of a bi-directional viscous dampener on the life of the hose and/or the remaining components of the hose reel assembly.

Although certain preferred embodiments and methods have been disclosed herein, it will be apparent from the foregoing disclosure to those skilled in the art that variations and modifications of such embodiments and methods may be made without departing from the spirit and scope of the invention. For example, if collar member 68 is keyed, splined or otherwise fixed to support shaft 32 to prevent rotation in either direction, the advantages of the multi-plate viscous clutch (i.e. compact construction) will still be realized although the advantages of the uni-directional viscous clutch would be sacrificed. Accordingly, it is intended that the invention shall be limited only to the extent required by the appended claims and the rules and principles of applicable law.

What claimed is:

1. An apparatus for storing an elongate member comprising:

a support frame;

a stationary support shaft attached to said support frame;

a one-way clutch assembly disposed on said stationary support shaft adapted for rotation thereabout, said one-way clutch assembly having a one-way clutch, said one-way clutch being capable of engaging to prevent rotation of said one-way clutch assembly about said stationary support shaft in a first rotational direction and disengaging to allow rotation of said one-way clutch assembly about said stationary support shaft in a second rotational direction;

a stator disk attached to said one way clutch assembly, said stator disk comprising a disk of hollow substantially circular cross section extending radially outward from said one-way clutch assembly;

a housing rotatably supported by said stationary support shaft disposed radially outward of said one-way clutch assembly, said housing defining an annular chamber around said stator disk, said annular chamber having a outer wall and an inner wall, said outer wall being disposed radially outward of said inner wall;

a rotor disk attached to said outer wall, said rotor disk comprising a disk of hollow substantially circular cross section extending radially inward from said outer wall, said rotor disk and said stator disk being disposed within said annular chamber in a juxtaposed spaced apart relationship defining an annular gap between said stator disk and said rotor disk;

a viscous fluid disposed within said annular chamber such that at least a portion of said annular gap is filled with said viscous fluid to form a viscous clutch therebetween;

a spool attached to said housing, said spool being adapted for winding the elongate member thereabout and;

a torsional spring operatively attached to said spool, said torsional spring urging said spool in the first rotational direction, whereby rotation of said reel in the second rotational direction against said torsional spring causes said one-way clutch to release such that said viscous clutch provides substantially no resistance and whereby conversely rotation of said reel in the first rotational direction as urged by said torsional spring causes said one-way clutch to engage such that said viscous clutch provides resistance to regulate the angular velocity of said reel in the second rotational direction.

2. The apparatus of claim 1, further comprising:

a plurality of rotor disks attached to said outer wall; and a plurality of stator disks attached to said one-way clutch assemblies, said plurality of rotor disks and said plurality of stator disks interleaved in alternating fashion to form a plurality of annular gaps therebetween each of said plurality of annular gaps formed by one of said plurality of rotor disks and one of said plurality of stator disks.

3. The apparatus of claim 1 wherein said elongate member comprises a hose, said apparatus further comprising:

a rotary valve attached to said reel for providing fluid communication between said hose and an external source of pressurized fluid.

4. The apparatus of claim 1 wherein said elongate member comprises an electrically conductive cable, said apparatus further comprising:

a slip ring connector attached to said reel for providing electrical continuity between said electrically conductive cable and an external voltage source.

5. A hose reel comprising;

a support frame;

a stationary support shaft attached to said support frame;

a spool supported for rotation about said stationary support shaft, said spool having a cylindrical body and a pair of flanges extending radially outward from opposite ends of said cylindrical body;

a length of hose wound around the spool, said length of hose having a first end extending exteriorly of said support frame;

a viscous clutch assembly attached to said spool, said viscous clutch assembly comprising a housing defining a sealed chamber, a viscous liquid contained therein, a plurality of rotor disks disposed in said sealed chamber operatively attached to said housing, and plurality of stator disks disposed between said plurality of rotor disks in alternating fashion forming a plurality of annular gaps between said plurality of rotor disks and said plurality of stator disks;

a collar member supported by said stationary support shaft and attached to said plurality of stator disks, said collar member being fixed to said stationary support shaft so as to resist rotation thereabout in at least one rotational direction; and a one-way clutch assembly disposed between said collar member and said stationary support shaft, said one-way clutch assembly including clutch means for preventing rotation of said one-way clutch assembly in a first rotational direction about said stationary support shaft, such that said stator disks are constrained against rotation with said rotor disks in said first rotational direction, said clutch means further permitting rotation of said one-way clutch assembly in a second rotational direction about said stationary support shaft such that said stator disks are capable of rotation with said rotor disks in said second direction, whereby said viscous clutch cooperates with said one-way clutch to provide viscous resistance to motion solely in said first rotational direction.

6. The hose reel of claim 5 wherein said clutch means comprises:

an enclosure disposed about said stationary support shaft;

a plurality of cylindrical rollers disposed within said enclosure, said plurality of cylindrical rollers having a diameter dimension;

said enclosure comprising an outer wall having an inner surface, said inner surface having formed therein a plurality of inclined ramps extending circumferentially in a sawtooth pattern, the plurality of ramps each having a root and a tip, the plurality of ramps being sized such that the radius of the inner surface at the root of each of the plurality of ramps is greater than the sum of the radius of said stationary support shaft and the diameter dimension of said rollers, and the radius of the inner surface at the tip of each of the plurality of inclined ramps is less than the sum of the radius of said stationary support shaft and the diameter dimension of said rollers, such that as said clutch means is rotated in a first rotational direction relative to said stationary support shaft, said plurality of rollers are wedged between said stationary support shaft and said inner surface of said housing thereby preventing further rotation of said clutch assembly in said first rotational direction.

7. The hose reel of claim 5 further comprising:

a rotary valve attached to said reel for providing fluid communication between a second end of said length of hose and an external source of pressurized fluid.

* * * * *